United States Patent [19]

Eklund et al.

[11] Patent Number: 5,010,839

[45] **Date of Patent: * Apr. 30, 1991**

[54] COATER FOR SELECTIVELY COATING A RUNNING WEB EITHER ON ONE SIDE OR ON BOTH SIDES

[75] Inventors: Dan Eklund, Kauniainen; Markku Gråsten, Järvenpää , both of Finland

[73] Assignee: Valmet Paper Machinery Inc., Helsinki, Finland

[ * ] Notice: The portion of the term of this patent subsequent to Dec. 15, 2004 has been disclaimed.

[21] Appl. No.: 121,668

[22] Filed: Nov. 17, 1987

Related U.S. Application Data

[63] Continuation of Ser. No. 580,882, Feb. 16, 1984, abandoned.

[30] Foreign Application Priority Data

Mar. 1, 1983 [FI] Finland ..... 830674

[51] Int. Cl.[5] ..... B05C 11/02

[52] U.S. Cl. ..... 118/122; 118/103; 118/117; 118/119; 118/407

[58] Field of Search ..... 118/405, 126, 115, 117, 118/119, 122, 407, 411, 412, 103

[56] References Cited

U.S. PATENT DOCUMENTS

| | | | |
|---|---|---|---|
| 3,179,536 | 4/1965 | Martinek | 118/103 X |
| 3,203,392 | 8/1965 | Edwards | 118/115 |
| 3,418,970 | 12/1968 | Phelps et al. | 118/410 |
| 3,874,283 | 4/1975 | Igarashi et al. | 118/119 X |
| 4,063,531 | 12/1977 | Zitzow | 118/122 |
| 4,231,318 | 11/1980 | Zink | 118/122 |
| 4,259,921 | 4/1981 | Wallsten | 118/414 X |
| 4,679,524 | 7/1987 | Eklund | 118/413 X |
| 4,712,506 | 12/1987 | Rantanen et al. | 118/103 |
| 4,822,640 | 4/1989 | Tuhkanen et al. | 118/103 X |

OTHER PUBLICATIONS

Abandoned Application Ser. No. 307,868; pp. 1-7 and FIGS. 1-5; Filed 10-2-81.

*Primary Examiner*—Shrive Beck
*Assistant Examiner*—Alain Bashore
*Attorney, Agent, or Firm*—Dellett, Smith-Hill & Bedell

[57] ABSTRACT

In a device for alternatively one- or double-sided coating of a running paper web the final evening-out of the coating is made in a smoothing nip including a first roll and a counter member. The device includes means for leading the web from below upwards into the smoothing nip. At a considerable distance before the smoothing nip, there is a coating substance applicator including an applicator chamber, where the coating substance is brought into a substantially non-pressurized contact with the running web for adhering thereto and travelling therewith upwards to the smoothing nip. The web moves linearly from the applicator to the smoothing nip.

14 Claims, 1 Drawing Sheet

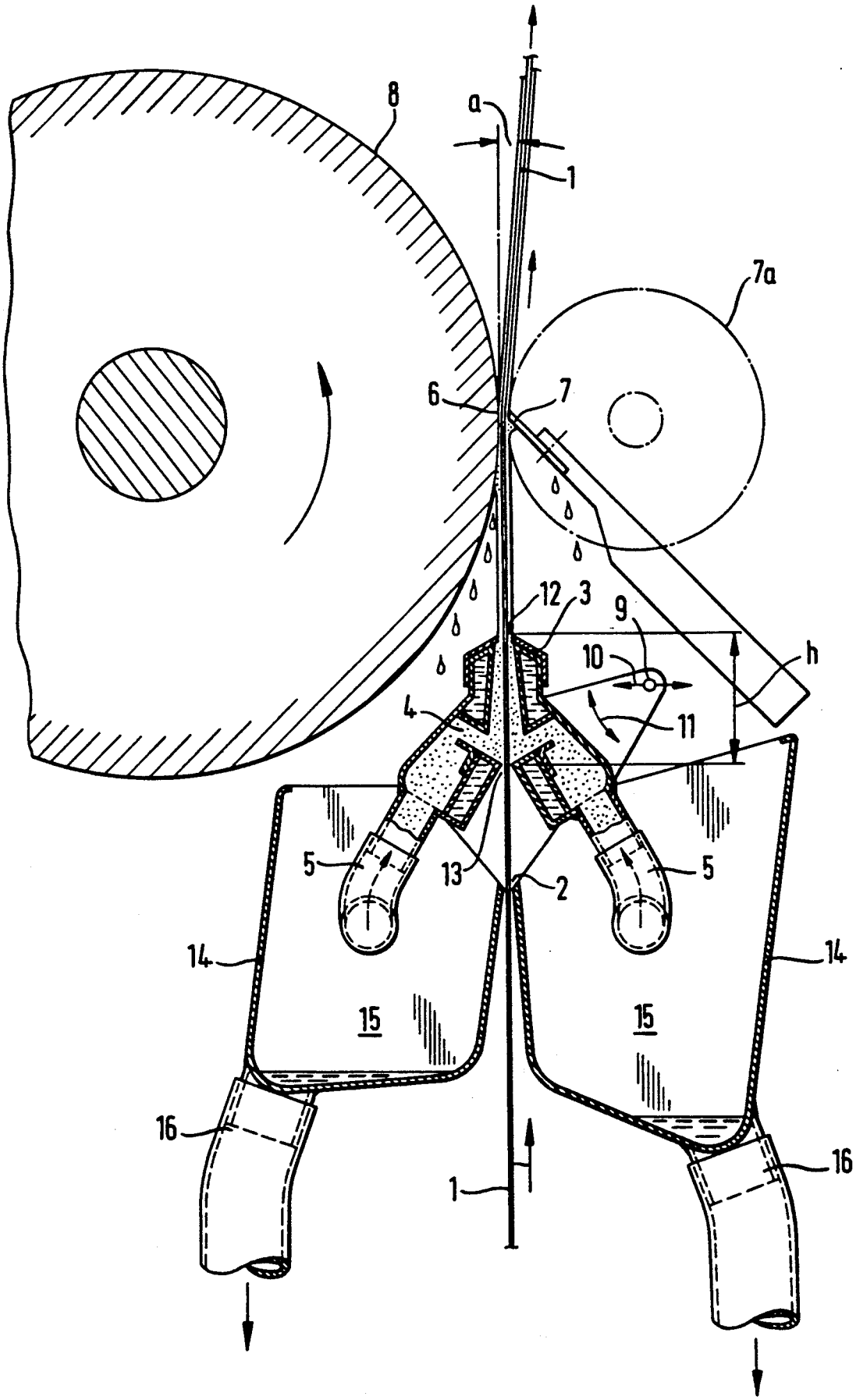
8
a
1
7a
6
7
12
3
9
10
h
4
11
5
13
2
5
14
14
15
15
16
16
1

COATER FOR SELECTIVELY COATING A RUNNING WEB EITHER ON ONE SIDE OR ON BOTH SIDES

This application is a continuation of U.S. patent Ser. No. 06/580,882, filed 2-16-84, now abandoned.

BACKGROUND OF THE INVENTION

The invention relates to a device for alternatively one- or double-sided coating of a running paper web, in which device the final evening-out of the coating is made in a smoothing nip including a roll and a counter piece.

The basic factors of coating are quality and speed. High coating speeds increase productivity, but high speeds make it difficult to fulfil the quality requirements. Nearly all possible design alternatives have been tested on coating devices. The web has been run both from above downwards and from below upwards, and also horizontally as well as aslant at different angles. Coating substance has been applied to the web with rolls, extruders, by spraying, by leading the web through a coating substance container, by forming a coating pond in contact with the web, and in many other ways. Some solutions have proved advantageous in certain applications, but all solutions have usually had considerable drawbacks, and their applicability to coating substances and coating conditions of different types has not been satisfactory.

SUMMARY OF THE INVENTION

The object of the invention is to create a universal coater which can be used for very many types of coating purposes in such a way that a good coating quality is obtained also at high coating speeds. The basic features of the invention are stated in claim 1. Such a coater fulfils the object of the invention. Since the web travels from below upwards, a static pond where impurities occurring in the coating substance accumulate is not formed in the smoothing nip. If excess coating substance accumulates in the smoothing nip, it flows away gradually, and in this way, the coating substance is continuously replaced and the nip remains clean. Since the coating substance is applied to the web mainly in a non-pressurized state, there is no essential pressure drop in the coating substance, and because of this, air bubbles expanding due to an abrupt pressure drop do not occur in the coating layer, as may be the case when using a pressure extruder for spreading the coating substance. As there is no mechanical contact between the web and the applicator, there is no risk of damage to the web caused by the applicator.

The most advantageous counter piece of the roll in the smoothing nip is a coating blade. The well-known combination "blade-web-roll" usually gives the best adjusting possibilities. However, it is also feasible that a pair of rolls is used for evening out the coating.

When a coating blade is used in the smoothing nip at one side of the web, it is possible to draw the web in such a way, that it slightly deflects at the blade tip. This is advantageous since the travelling direction of the web will then deviate from the tangential plane of the roll at the smoothing nip in a direction away from the roll. This gives a better coating result on the roll side, since the enlarged angle between the web and the roll reduces the risk of so-called film-splitting. It is also advantageous that the travelling direction of the web before the smoothing nip slightly deviates from the tangential plane of the roll.

In a device according to the invention, a mainly closed collecting space is preferably arranged around the applicator and below the smoothing nip for collection and reuse of excess coating substance. The walls of the collecting space extend as close to the smoothing-nip roll and the smoothing-blade holder as possible. The walls of the collecting space then protect the coating device from coating substance splashes at the end of the coating process or in case of a web break. The coating substance accumulated in the lower part of the collecting space may be pumped back into the coating substance feeding system.

In the applicator, the web is in contact with the coating substance over a considerable distance. The process can be adjusted so that the applicator is kept full of coating substance or the coating substance level is kept at a certain height. The applicator can be filled with a different coating substance at both sides of the web or one side of the web can be left uncoated. Over-pressure is not used in the applicator, the coating substance being brought onto the web by means of a non-pressurized contact. However, a certain hydrostatic pressure affecting the web prevails in the coating substance volume of the applicator. If the web is coated only on one side, air must be fed to the other side of the applicator at a suitable slight over-pressure for maintaining a pressure balance. The gaps between the lower and upper edges of the applicator and the web can be adjusted by changing the distance between the applicator halves and the web, and/or the angle position of the applicator halves. The gap between the upper edges of the applicator and the web is usually adjusted to the value 0.2–2 mm, preferably 0.2–1 mm. The gap between the lower edges of the applicator and the web is usually adjusted to the same value as the upper gap or to a slightly larger value. The lower gap can be for example 20% larger than the upper gap, but preferably not more than 50% larger. It is recommended that a small amount of coating substance continuously flows from the lower gap of the applicator during coating, since this prevents the entry of air into the applicator with the web. However, this flow should be as small as possible. From the point of view of the coating-process control, it is advantageous, that the web in the applicator is in contact with coating substance over a distance of at least 5 cm, preferably at least 10 cm.

In a preferred embodiment of the invention, the distance from the applicator to the smoothing nip is 5–50 cm, preferably 10–30 cm. For obtaining a compact construction, the distance mentioned should be kept as short as possible. However, a certain distance is always needed between the applicator and the smoothing nip.

BRIEF DESCRIPTION OF THE DRAWINGS

The invention will now be described more in detail with reference to the accompanying drawing, the single Figure of which schematically shows a cross-sectional view of a device according to the invention.

DESCRIPTION OF THE PREFERRED EMBODIMENTS

In the drawing, 1 designates a running web that moves from below upwards. Through a gap 2, the web enters into a mainly closed space 15, in which is located a coating substance applicator 3. In the applicator, the web comes into contact with coating substance contained therein. The coating substance is pumped into the interior 4 of the applicator 3 through pipes 5, and the pumping pressure is regulated so that no actual over-pressure prevails in the applicator. However, there must be so much over-pressure in the pipes 5 that the coating substance level in the applicator settles at a desired height. In the applicator, the coating substance adheres to the web 1 and travels with it to a smoothing nip 6, where the coating in the embodiment shown in the drawing is evened out by means of a coating blade 7 and a roll 8 located at opposite sides of the web. The coating blade can be replaced by another roll 7*a* schematically shown by dash-and-dot lines.

At the tip of the coating blade 7, the web 1 slightly deflects away from the tangential plane of the roll 8 as shown in the drawing. This gives a better coating result. The travelling direction of the web may also on the ingoing side of the smoothing nip deviate from the tangential plane of the roll 8. In the smoothing nip 6, the angle of the blade 7 as well as the nip load caused by the blade and affecting the coating can be adjusted. Selection of the proper adjustment values is mainly based on the paper grade, the web speed and the coating substance quality as well as on the thickness and flexibility of the blade 7.

The control systems of the applicator 3 are shown only schematically and only at one side of the applicator. The two halves of the applicator are supported at a fixed point 9, the position of which may be adjusted as indicated by arrows 10. Angular adjustment of the applicator is realized by a turning movement 11 around the fixed point 9. The applicator halves are adjusted so that gaps of a desired width appear at the upper edge 12 and lower edge 13 of the applicator. Suitable adjustment values have been mentioned above.

Two collecting troughs 14 that together form the collecting space 15 are arranged around the applicator. Excess coating substance dripping from the smoothing nip 6 and also dropping slightly through the gap of the lower edge 13 of the applicator accumulates in this collecting space. The collecting troughs 14 also act as guards for the applicator and form together with the roll 8 and the holder of the blade 7 a mainly closed space that protects the applicator and the whole coating process. The coating substance accumulated in the lower section 15 of the collecting space is led through pipes 16 back to the coating substance feeding system, from which it is brought back into the applicator through the pipes 5.

To make it possible to use a device according to the invention for coating with different types of coating substances it is important that the contact distance h between the web and the coating substance is sufficiently long. The distance h should preferably be at least 10 cm. Ordinary pigment and size coatings can be used in a device according to the invention. The coating substance viscosity should preferably be less than 3000 mPas. In the smoothing nip, the roll 8 can run slightly faster than the web 1.

The invention is not limited to the embodiment shown, but several modifications thereof are feasible within the scope of the attached claims.

We claim:

1. A device for coating at least one side of a running paper web, comprising:

a roll having a central axis, means supporting the roll for rotation about its central axis, a counter piece which cooperates with the roll to define a smoothing nip, a coating substance applicator disposed below the smoothing nip and spaced therefrom along a linear path of movement of the web, said applicator comprising means defining an applicator chamber at one side of said path of movement, and means for feeding coating substance to the applicator chamber to form therein a body of coating substance in substantially non-pressurized contact over a contact distance of at least 5 cm with one side of a web passing upwardly along said path to the smoothing nip, said means defining the applicator chamber being spaced from the path of movement of the web, allowing the coating substance to contact the web in substantially non-pressurized manner and also allowing the web to run through the applicator substantially without any mechanical contact with the applicator, and means defining a collecting space below said applicator and said smoothing nip for collecting excess coating substance and leading it to a recycling system.

2. A device according to claim 1, comprising means for causing the running web leaving the smoothing nip to be deflected slightly away from the tangent to said roll at the smoothing nip.

3. A device according to claim 2, wherein said linear path deviates slightly from the direction of the tangent to said roll at the smoothing nip.

4. A device according to claim 1, wherein the counter piece is a coating blade.

5. A device according to claim 1, wherein the counter piece is a second roll.

6. A device according to claim 1, wherein said contact distance is at least 10 cm.

7. A device according to claim 1, wherein the distance from the applicator to the smoothing nip is between 5 and 50 cm.

8. A device according to claim 7, wherein the distance from the applicator to the smoothing nip is between 10 and 30 cm.

9. A device according to claim 1, wherein said applicator comprises means defining first and second applicator chambers at opposite respective sides of said path of movement and means for feeding coating substance to the first and second applicator chambers, and wherein the applicator defines a gap for the web, allowing the coating substance delivered to the first and second chambers to contact respective sides of the web in substantially non-pressurized manner and also allowing the web to run through the applicator substantially without any mechanical contact with the applicator.

10. A device according to claim 9, wherein the applicator has upper edges defining said gap and the gap is sized so that there is a space between the web and the upper edges of the applicator of between 0.2 and 2 mm.

11. A device according to claim 20, wherein said space is between 0.2 and 1 mm.

12. A device according to claim 10, wherein the applicator has lower edges defining a second gap for the web, the second gap being sized so that there is a space between the web and the lower edges of the applicator that is at least as large as the space between the web and the upper edges of the applicator.

13. A device according to claim 12, wherein the space between the web and the lower edges of the applicator is at the most 50% larger than the space between the web and the upper edges of the applicator.

14. A device according to claim 12, wherein the size of the second gap is adjustable to control the amount of coating substance that leaves the applicator chamber by way of the second gap.

* * * * *